US009200876B1

(12) United States Patent
Thomas et al.

(10) Patent No.: US 9,200,876 B1
(45) Date of Patent: Dec. 1, 2015

(54) MULTIPLE-CHARGE CARTRIDGE

(71) Applicant: Lockheed Martin Corporation, Bethesda, MD (US)

(72) Inventors: Toby D. Thomas, Southlake, TX (US); Jonathan H. Record, Grand Prairie, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/198,721

(22) Filed: Mar. 6, 2014

(51) Int. Cl.
*F42B 5/16* (2006.01)
*F42B 5/02* (2006.01)

(52) U.S. Cl.
CPC .... *F42B 5/02* (2013.01); *F42B 5/16* (2013.01)

(58) Field of Classification Search
CPC ..... F42B 5/16; F42B 5/00; F42B 5/035; F42B 5/105; F42B 5/285; F42B 5/38; F42B 5/34; F42B 5/02
USPC ..... 102/430, 432, 439, 448, 466, 467, 469, 102/470, 443, 487, 370
See application file for complete search history.

(56) References Cited

U.S. PATENT DOCUMENTS 2,821,924 A 2/1958 Hansen et al.
3,283,719 A * 11/1966 Grandy ..... 102/443
3,650,213 A 3/1972 Abbott et al.
3,701,533 A 10/1972 Palmer
3,802,345 A 4/1974 La Costa
3,865,038 A 2/1975 Barr
3,940,605 A 2/1976 Gerber
3,954,060 A 5/1976 Haag et al.
4,326,463 A 4/1982 Burke et al.
4,455,943 A 6/1984 Pinson
4,594,944 A 6/1986 Rongus et al.
4,619,202 A * 10/1986 Romer et al. ..... 102/443
4,638,736 A 1/1987 Farmer
4,638,737 A 1/1987 McIngvale
4,706,568 A 11/1987 Lundwall et al.
4,777,882 A 10/1988 Dieval
4,922,826 A 5/1990 Busch et al.

(Continued)

FOREIGN PATENT DOCUMENTS

FR 2792399 A1 10/2000
WO 2013053016 A1 4/2013

OTHER PUBLICATIONS

Non-Final Office Action for U.S. Appl. No. 12/914,803, mailed Aug. 29, 2014, 11 pages.

(Continued)

*Primary Examiner* — Samir Abdosh
*Assistant Examiner* — John D. Cooper
(74) *Attorney, Agent, or Firm* — Withrow & Terranova, PLLC

(57) ABSTRACT

A multiple-charge cartridge is disclosed. The cartridge includes an annular casing having an interior void and a primer. A rotatable selector ring is positioned circumferentially about at least a portion of the annular casing. A cam is positioned in the interior void and includes a first charge and a second charge. The cam is coupled to the rotatable selector ring and is configured to rotate about an axis in response to a rotation of the rotatable selector ring. The cam is configured to align the first charge with the primer in response to a rotation of the rotatable selector ring to a first user-selectable position, and to align the second charge with the primer in response to a rotation of the rotatable selector ring to a second user-selectable position.

20 Claims, 5 Drawing Sheets

(56) References Cited

U.S. PATENT DOCUMENTS

| | | | | |
|---|---|---|---|---|
| 4,957,046 | A | 9/1990 | Puttock | |
| 5,082,203 | A | 1/1992 | Baubry | |
| 5,119,715 | A | 6/1992 | Porter, Jr. et al. | |
| 5,221,809 | A | 6/1993 | Cuadros | |
| 5,635,667 | A * | 6/1997 | Boyer et al. | 102/487 |
| 5,654,524 | A | 8/1997 | Saxby | |
| 5,661,257 | A | 8/1997 | Nielson et al. | |
| 5,796,031 | A | 8/1998 | Sigler | |
| 5,817,969 | A | 10/1998 | Ettmuller | |
| 5,880,397 | A * | 3/1999 | Crilly | 102/443 |
| 6,142,056 | A | 11/2000 | Taleyarkhan | |
| 6,223,658 | B1 | 5/2001 | Rosa et al. | |
| 6,269,747 | B1 | 8/2001 | Strandli et al. | |
| 6,393,992 | B1 | 5/2002 | Vasel et al. | |
| 6,432,715 | B1 | 8/2002 | Nelson et al. | |
| 6,523,478 | B1 | 2/2003 | Gonzalez et al. | |
| 6,598,534 | B2 | 7/2003 | Lloyd et al. | |
| 6,688,032 | B1 | 2/2004 | Gonzalez et al. | |
| 6,843,179 | B2 | 1/2005 | Hunn et al. | |
| 6,871,594 | B1 | 3/2005 | Estrella | |
| 6,957,609 | B2 | 10/2005 | Ronn et al. | |
| 6,989,525 | B2 | 1/2006 | Howard | |
| 7,032,521 | B2 | 4/2006 | Ronn et al. | |
| 7,060,992 | B1 | 6/2006 | Barney | |
| 7,107,910 | B2 | 9/2006 | Hunn et al. | |
| 7,143,698 | B2 | 12/2006 | Lloyd | |
| 7,261,040 | B2 | 8/2007 | Hunn et al. | |
| 7,278,358 | B2 | 10/2007 | Huffman | |
| 7,380,503 | B2 | 6/2008 | Williams et al. | |
| 7,490,551 | B2 | 2/2009 | Golay et al. | |
| 7,530,315 | B2 | 5/2009 | Tepera et al. | |
| 7,600,475 | B1 | 10/2009 | Friedberg | |
| 7,743,709 | B2 | 6/2010 | Kolnik et al. | |
| 7,752,976 | B2 | 7/2010 | Banks | |
| 7,819,065 | B2 | 10/2010 | Haeselich | |
| 7,905,178 | B2 | 3/2011 | Dryer et al. | |
| 7,930,977 | B2 | 4/2011 | Klein | |
| 8,020,492 | B1 | 9/2011 | Kapeles | |
| 8,061,274 | B1 | 11/2011 | Hayes et al. | |
| 8,115,149 | B1 | 2/2012 | Manole et al. | |
| 8,196,514 | B2 | 6/2012 | Gustafsson et al. | |
| 8,240,252 | B2 | 8/2012 | Maljkovic et al. | |
| 8,281,720 | B2 | 10/2012 | Dindl et al. | |
| 8,286,557 | B2 | 10/2012 | Endicott et al. | |
| 8,387,538 | B2 | 3/2013 | Elder | |
| 8,415,598 | B1 | 4/2013 | Terhune et al. | |
| 8,464,639 | B2 | 6/2013 | Thomas et al. | |
| 8,511,231 | B2 | 8/2013 | Hayes et al. | |
| 8,616,127 | B2 | 12/2013 | Aliaghai et al. | |
| 8,661,981 | B2 | 3/2014 | Tepera et al. | |
| 8,708,285 | B1 | 4/2014 | Carreiro | |
| 9,068,807 | B1 * | 6/2015 | Thomas et al. | 102/370 |
| 2002/0174794 | A1 | 11/2002 | Lowden et al. | |
| 2005/0016412 | A1 | 1/2005 | Vasel et al. | |
| 2005/0188886 | A1 | 9/2005 | Vasel et al. | |
| 2007/0068414 | A1 | 3/2007 | O'Dwyer et al. | |
| 2009/0013893 | A1 | 1/2009 | Vasel et al. | |
| 2010/0000438 | A1 * | 1/2010 | Dryer et al. | 102/443 |
| 2010/0275807 | A1 | 11/2010 | Landry et al. | |
| 2011/0056402 | A1 | 3/2011 | Gustavsson et al. | |
| 2011/0067593 | A1 | 3/2011 | Klein | |
| 2011/0203475 | A1 | 8/2011 | Thuman | |
| 2011/0233426 | A1 | 9/2011 | Carroll et al. | |
| 2012/0006218 | A1 | 1/2012 | Dietrich | |
| 2012/0006219 | A1 | 1/2012 | Dietrich | |
| 2012/0180686 | A1 | 7/2012 | Jones et al. | |
| 2012/0227614 | A1 | 9/2012 | Sullivan | |
| 2013/0087063 | A1 | 4/2013 | Halter | |
| 2014/0025328 | A1 | 1/2014 | Burns et al. | |
| 2014/0041545 | A1 | 2/2014 | Aw et al. | |

OTHER PUBLICATIONS

Author Unknown, "Army Ammunition Data Sheets for Artillery Ammunition: Guns, Howitzers, Mortars, Recoilless Rifles, Grenade Launchers, and Artillery Fuzes," Technical Manual 43-0001-28, Change 15, Headquarters, Department of the Army, Oct. 2006, pp. 6-11 through 6-13.

Author Unknown, "Flight controlled Mortar (FCMortar)," Request for Information, Solicitation No. N0017813Q1010, Posted Mar. 27, 2013, Naval Surface Warfare Center, Dahlgren, Virginia, 7 pages.

Henderson, Milton E., Jr., "Fuze Efforts," AMRDEC, Weapons Development and Integration Directorate, Systems & Warheads Function, (RDMR-WDP-S), May 7, 2012, Control # FN5850, 15 pages.

Sandia National Laboratories et al., "Variable Range Less-Than-Lethal Ballistics," Final Report to the National Institute of Justice on Grant No. 2000-LT-BX-K004, Document No. 199046, U.S. Department of Justice, Jan. 2003, 66 pages.

Singh, Anant, "Degradable Taggants & Automated Multi-platform Sensor for Intelligence, Surveillance and Reconnassaince," Narrative Briefing, Command: ONR—SBIR, Topic: N07-072, TIAX LLC, 2010, Lexington, Massachusetts, 6 pages.

Non-Final Office Action for U.S. Appl. No. 13/296,408, mailed Mar. 22, 2013, 9 pages.

Final Office Action for U.S. Appl. No. 13/296,408, mailed Oct. 21, 2013, 10 pages.

Final Office Action for U.S. Appl. No. 13/296,408, mailed Feb. 10, 2014, 14 pages.

Applicant-Initiated Interview Summary for U.S. Appl. No. 13/296,408, mailed Mar. 26, 2014, 3 pages.

Advisory Action for U.S. Appl. No. 13/296,408, mailed May 1, 2014, 3 pages.

Notice of Allowance for U.S. Appl. No. 12/914,803, mailed Jan. 6, 2015, 7 pages.

Notice of Allowance for U.S. Appl. No. 13/296,408 mailed Mar. 19, 2015, 8 pages.

Non-Final Office Action for U.S. Appl. No. 14/198,732, mailed May 6, 2015, 14 pages.

* cited by examiner

MULTIPLE-CHARGE CARTRIDGE

TECHNICAL FIELD

The embodiments relate to a multiple-charge cartridge.

BACKGROUND

Ammunition cartridges are typically manufactured with a predetermined charge. A particular cartridge may be selected for use at a particular range, or distance. Sometimes, to eliminate the need to carry around a variety of different cartridges, the charge of a cartridge may be designed to handle a variety of ranges, but this may result in compromise when used for longer ranges, in which case the projectile may lack the desired energy at impact, or for shorter ranges, in which case the projectile may be too energetic at impact, and cause injury or death. This may be particularly problematic in the context of less-than-lethal (LTL) cartridges, which are often used by military and law enforcement to inhibit dangerous behavior, such as may be posed by an unruly crowd. Ideally, a projectile emitted from an LTL cartridge discourages behavior, but does not maim or fatally injure individuals.

SUMMARY

The embodiments relate to a multiple-charge cartridge, wherein a user of the cartridge may select a particular charge from a plurality of charges prior to chambering the cartridge. In one embodiment, a cartridge is provided that includes an annular casing that has an interior void and a primer. A rotatable selector ring is positioned circumferentially about at least a portion of the annular casing. A cam is positioned in the interior void and includes a first charge and a second charge. The cam is coupled to the rotatable selector ring and is configured to rotate about an axis in response to a rotation of the rotatable selector ring. The cam is configured to align the first charge with the primer in response to a rotation of the rotatable selector ring to a first user-selectable position, and to align the second charge with the primer in response to a rotation of the rotatable selector ring to a second user-selectable position.

In one embodiment, the annular casing forms an opening between a portion of the rotatable selector ring and the cam. The rotatable selector ring includes an extension that is configured to extend through the opening and engage a recess of the cam, to couple the cam to the rotatable selector ring.

In one embodiment, the first charge is configured to generate a first energy upon detonation, and the second charge is configured to generate a second energy upon detonation that is greater than the first energy.

In one embodiment, the cam includes at least a first surface indentation associated with the first charge and a second surface indentation associated with the second charge. The cartridge includes a plunger disposed within the interior void. The plunger is configured to engage the first surface indentation when the rotatable selector ring is in the first user-selectable position and to engage the second surface indentation when the rotatable selector ring is in the second user-selectable position. In one embodiment, the plunger comprises a spring in compressible communication with a ball. The spring is configured to urge the ball against the cam to provide resistance, via the cam, to a rotation of the rotatable selector ring.

In one embodiment, the cartridge further includes a pressure chamber that is formed at least in part by a plate that separates the pressure chamber from the interior void. The plate forms an opening between the pressure chamber and the interior void. In the first user-selectable position of the rotatable selector ring, the cam is configured to align a detonation direction of the first charge with the opening, and in the second user-selectable position of the rotatable selector ring, the cam is configured to align a detonation direction of the second charge with the opening, such that the selected charge detonates into the pressure chamber.

In one embodiment, the first charge is located within a first void of the cam, and the second charge is located within a second void of the cam. The cam forms a first vent opening between the first void and the interior void and a second vent opening between the second void and the interior void. A first burstable layer is positioned between the first charge and the first vent opening, and a second burstable layer is positioned between the second charge and the second vent opening. In one embodiment, the cartridge may include a fuse coupled between the first charge and the second charge. The fuse is positioned to ignite upon detonation of a selected charge and configured to detonate an unselected charge. The unselected charge is configured to direct energy through the respective burstable layer and into the interior void upon ignition.

In another embodiment, a multiple-charge cartridge is provided. The cartridge includes an annular casing having an interior void and a primer charge. A rotatable selector ring is positioned circumferentially about at least a portion of the annular casing. A cam including the first charge and the second charge is positioned in the interior void and is coupled to the rotatable selector ring. The cam includes at least a first surface indentation associated with a first charge and a second surface indentation associated with a second charge. The cartridge includes a plunger that is configured to selectively engage a selected surface indentation of at least the first surface indentation and the second surface indentation in response to a rotation of the rotatable selector ring to facilitate user selection of the first charge or the second charge.

In another embodiment, a charge-selectable cartridge is provided. The cartridge includes a casing that forms an interior void. A rotatable selector ring is positioned circumferentially about at least a portion of an exterior surface of the casing. A cam is positioned in the interior void and is rotatably coupled to the rotatable selector ring. The cam is configured to set the cartridge to a first charge for a first range, and to a second charge for a second range that is different from the first range, based on a setting of the rotatable selector ring.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The use herein of ordinals in conjunction with an element is solely for distinguishing what might otherwise be similar or identical labels, such as "first charge" and "second charge," and does not imply a priority, a type, an importance, or other attribute, unless otherwise stated herein.

The embodiments relate to a user-selectable multiple-charge cartridge that facilitates selection of a desired charge based on the distance, sometimes referred to as range, between the user of a firearm and an intended target. While the embodiments are discussed herein in the context of a less-than-lethal (LTL) cartridge, the embodiments are not limited to use in a LTL cartridge, and have applicability in any context in which it may be desirable to allow the user of a cartridge to select a desired charge from a plurality of different charges.

Figure 1:
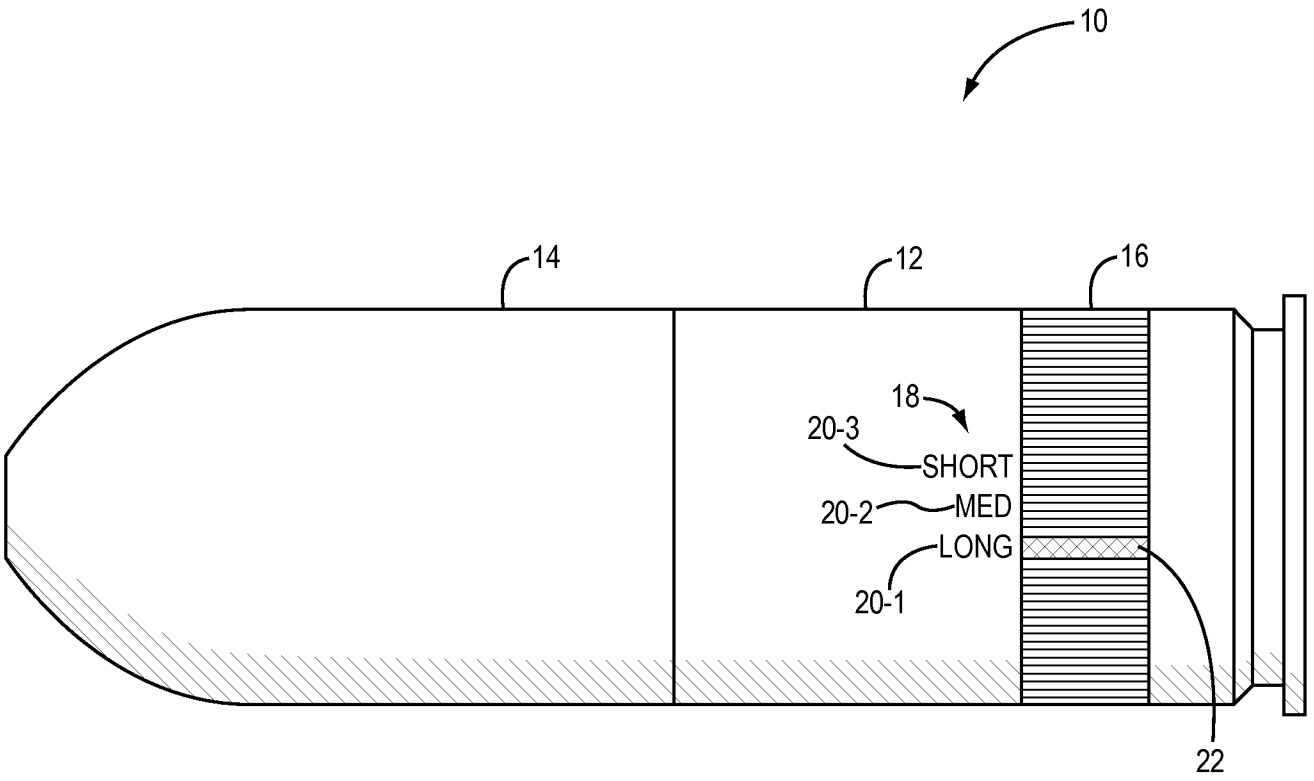
FIG. 1 is a diagram of a multiple-charge cartridge, according to one embodiment.

FIG. 1 is a diagram of a multiple-charge cartridge 10, according to one embodiment. The cartridge 10 may also be referred to herein as a user-selectable cartridge or a charge-selectable cartridge. The cartridge 10 includes an annular casing 12. The annular casing 12 may comprise any desired material, and will typically comprise a metal, such as brass, or the like. The cartridge 10 also includes a projectile 14, which, in some embodiments, may comprise a less-than-lethal (LTL) projectile useful, for example, for controlling individuals or crowds by law enforcement or military personnel.

The cartridge 10 includes a rotatable selector ring 16 that is positioned circumferentially about at least a portion of an exterior surface of the annular casing 12. In some embodiments, the annular casing 12 includes one or more indicia 18 that may identify a plurality of user-selectable positions 20-1-20-3 (generally, user-selectable positions 20). While for purposes of illustration the embodiments are discussed herein in the context of three user-selectable positions 20, the embodiments are not limited to any particular number of user-selectable positions 20, and may comprise two, four, or more user-selectable positions 20.

In the example illustrated in FIG. 1, the indicia 18 indicate the user-selectable position 20-1 is associated with a "long" range, the user-selectable position 20-2 is associated with a "medium" range, and the user-selectable position 20-3 is associated with a "short" range. The rotatable selector ring 16 may include a selection indicator 22 that may be aligned by the user through rotation of the rotatable selector ring 16 with a desired user-selectable position 20. In some embodiments, the indicia 18 may include recommended ranges, such as "<50 yards", "50-100 yards", and ">100 yards".

Figure 2:
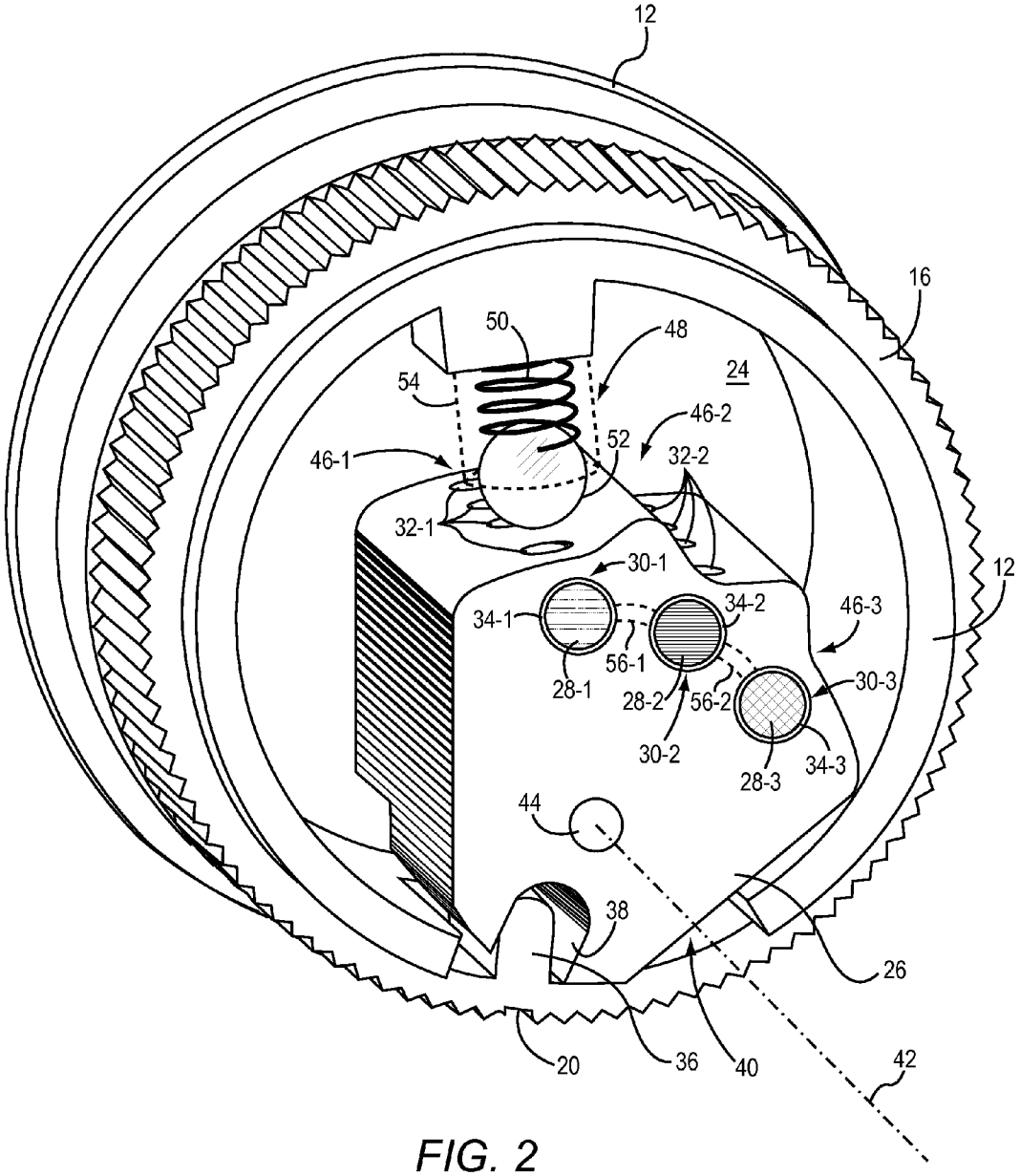
FIG. 2 is a diagram illustrating aspects of an interior of an annular casing, according to one embodiment.

FIG. 2 is a diagram illustrating aspects of the interior of the annular casing 12, according to one embodiment. The annular casing 12 forms an interior void 24. A cam 26 is disposed, or otherwise positioned, within the interior void 24. The cam 26 includes a charge 28-1, a charge 28-2, and a charge 28-3 (generally, charges 28). Each of the charges 28-1-28-3 are positioned within respective voids 30-1-30-3 of the cam 26. The cam 26 includes a plurality of vent openings 32-1 that are associated with the charge 28-1 and the void 30-1. As will be discussed in greater detail herein, the vent openings 32-1 provide a mechanism through which unselected charges 28 may direct energy upon detonation subsequent to the detonation of a selected charge 28. Similarly, vent openings 32-2 are formed in the cam 26 and associated with the charge 28-2 and the void 30-2. Due to the nature of the drawing in FIG. 2, the vent openings associated with the charge 28-3 and the void 30-3 cannot be seen.

In some embodiments, each of the charges 28-1-28-3 are completely, or at least partially, surrounded by a respective burstable layer 34-1-34-3, to seal the respective charges 28 from the respective vent openings 32. In this manner, energy directed from the detonation of a selected charge 28 through the respective vent openings 32 and into the interior void 24 will not ignite the unselected charges 28 via the respective vent openings 32 associated with such unselected charges 28. The burstable layers 34 may comprise any suitable material, such as foil, or any other non-flammable material. In some embodiments, rather than being located within the respective voids 30, the respective burstable layers 34 may be located within the respective vent openings 32.

The rotatable selector ring 16 includes an extension 36 that projects or otherwise extends into a recess 38 of the cam 26 through an opening 40 formed in the annular casing 12. The engagement of the extension 36 with the recess 38 rotatably couples the cam 26 to the rotatable selector ring 16. The cam 26 is configured to rotate about an axis 42 via a pin 44 in response to a rotation of the rotatable selector ring 16. The cam 26 is configured to align the charge 28-1 with a primer (not illustrated in FIG. 2), in response to a rotation of the rotatable selector ring 16 to the first user-selectable position 20-1 (FIG. 1). For example, referring again to FIG. 1, a rotation of the rotatable selector ring 16 to the user-selectable position 20-1 may align the charge 28-1 with the primer. Each user-selectable position 20 may result in a different charge 28 being aligned with the primer. For example, rotation of the rotatable selector ring 16 to the user-selectable position 20-2 may cause the cam 26 to align the charge 28-2 with the primer, and rotation of the rotatable selector ring 16 to the user-selectable position 20-3 may result in the cam 26 aligning the charge 28-3 with the primer.

The charges 28 may comprise any suitable exothermic material such as, by way of non-limiting example, gunpowder. Each of the charges 28 may have different detonation energies. For example, the detonation energy of the charge 28-1, associated with the user-selectable position 20-1, may have a greater energy upon detonation than the energy associated with the detonation of the charge 28-2. Similarly, the detonation energy of the charge 28-2 may be greater than the energy associated with the detonation of the charge 28-3.

In one embodiment, the cam 26 comprises a first surface indentation 46-1 associated with the charge 28-1, a second surface indentation 46-2 associated with the charge 28-2, and a third surface indentation 46-3 associated with the charge 28-3. The cartridge 10 includes a plunger 48 disposed within the interior void 24. The plunger 48 is configured to engage the first surface indentation 46-1 when the rotatable selector ring 16 is in the user-selectable position 20-1, to engage the second surface indentation 46-2 when the rotatable selector ring 16 is in the user-selectable position 20-2, and to engage the third surface indentation 46-3 when the rotatable selector ring 16 is in the user-selectable position 20-3.

In one embodiment, the plunger 48 comprises a spring 50 in compressible communication with a ball 52 contained within a sleeve 54. The spring 50 is configured to urge the ball 52 against the cam 26 to provide resistance via the cam 26 to a rotation of the rotatable selector ring 16, such that the user feels resistance when rotating the rotatable selector ring 16 from one user-selectable position 20 to another user-selectable position 20, and also to provide possible feedback as to when the user-selectable position 20 has been properly selected. While the spring 50 and ball 52 comprise one type of suitable plunger 48, those skilled in the art will recognize that other types of plungers 48 may be utilized to provide similar functionality. In one embodiment, the plunger 48 is configured to selectively engage a selected surface indentation 46 of a plurality of surface indentations 46 in response to a rotation of the rotatable selector ring 16 to facilitate user selection of the charge 28-1, the charge 28-2, or the charge 28-3.

In one embodiment, a fuse 56-1 may couple the charge 28-1 to the charge 28-2, and a fuse 56-2 may couple the charge 28-2 to the charge 28-3. The fuses 56 are positioned to ignite upon detonation of an adjacent charge 28 and are configured to detonate an unselected charge 28. In one embodiment, a respective fuse 56 is configured to detonate a respective unselected charge 28 within a period of time between about one-third of a second and about one second of ignition of the respective fuse 56. For example, assume that the user selects the charge 28-1 associated with the user-selectable position 20-1 as the desired charge 28 for launching the projectile 14 (FIG. 1). Upon detonation of the charge 28-1, the fuse 56-1 will ignite and a short time thereafter, will cause detonation of the charge 28-2. The charge 28-2 will detonate primarily through the vent openings 32-2 into the interior void 24. The detonation of the charge 28-2 will cause the ignition of the fuse 56-2, which will subsequently cause the detonation of the charge 28-3 through associated vent openings into the interior void 24. In this manner, within a very brief period of time after firing the selected charge 28-1, the remaining unselected charges 28-2, 28-3 are safely detonated, and the cartridge 10 thereafter contains no undetonated charges 28. This eliminates the problem associated with what would otherwise be undetonated charges 28 remaining in the cartridge 10. While each charge 28 is illustrated as being coupled to another charge 28 by a single fuse 56, it will be appreciated that multiple fuses 56 may be used to couple pairs of charges 28 for purposes of detonating unselected charges 28.

Figure 3:
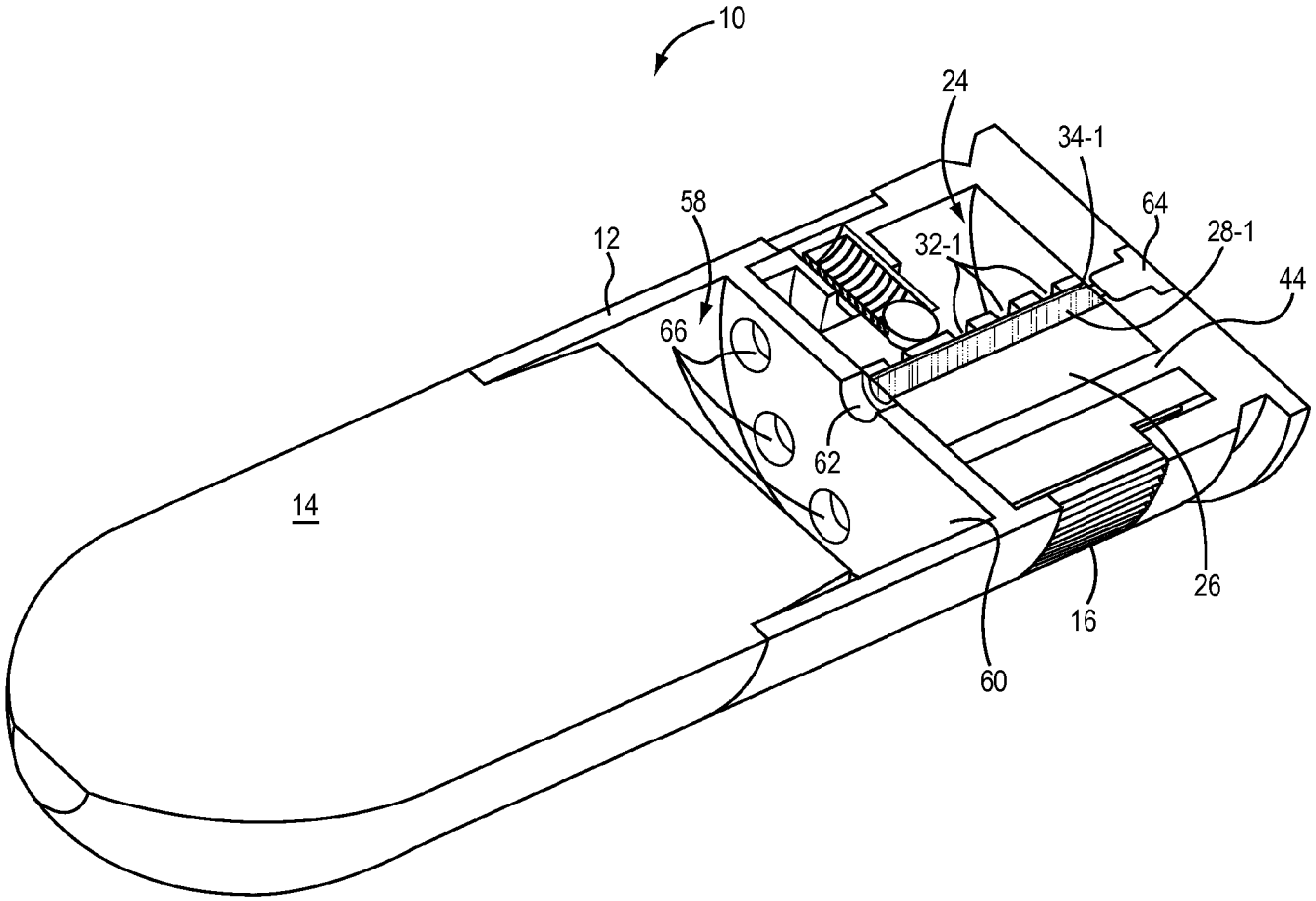
FIG. 3 is a diagram illustrating an interior of a cartridge, according to one embodiment.

FIG. 3 is a diagram illustrating the interior of the cartridge 10, according to one embodiment. In this embodiment, the cartridge 10 comprises a pressure chamber 58 formed at least in part by a plate 60 that separates the pressure chamber 58 from the interior void 24. The plate 60 forms a detonation opening 62 between the pressure chamber 58 and the interior void 24 such that in the user-selectable position 20-1 of the rotatable selector ring 16, the charge 28-1 is aligned with the detonation opening 62. In the user-selectable position 20-2 of the rotatable selector ring 16, the charge 28-2 would be aligned with the detonation opening 62. In the user-selectable position 20-3 of the rotatable selector ring 16, the charge 28-3 would be aligned with the detonation opening 62. Note that in the user-selectable position 20-1, the charge 28-1 is aligned with a primer 64. The primer 64, sometimes referred to as a primer charge, is configured to, upon ignition, ignite a selected charge 28 that is aligned with the primer 64. The plate 60 also forms one or more openings 66 between the pressure chamber 58 and the interior void 24 that facilitates pressure exchange between the interior void 24 and the pressure chamber 58 upon detonation of an unselected charge 28 via a fuse 56.

In operation, assume that the user has selected the user-selectable position 20-1, and the charge 28-1 is aligned with the primer 64, as illustrated in FIG. 3. Upon activation of a trigger, a firing pin strikes the primer 64, which ignites and detonates the charge 28-1. The charge 28-1 detonates generating a controlled explosion into the pressure chamber 58 via the detonation opening 62 and into the interior void 24 via the vent openings 32-1. When sufficient pressure has built, the projectile 14 is forced from the annular casing 12, down a barrel of a firearm, and out a muzzle of the firearm.

Figure 4:
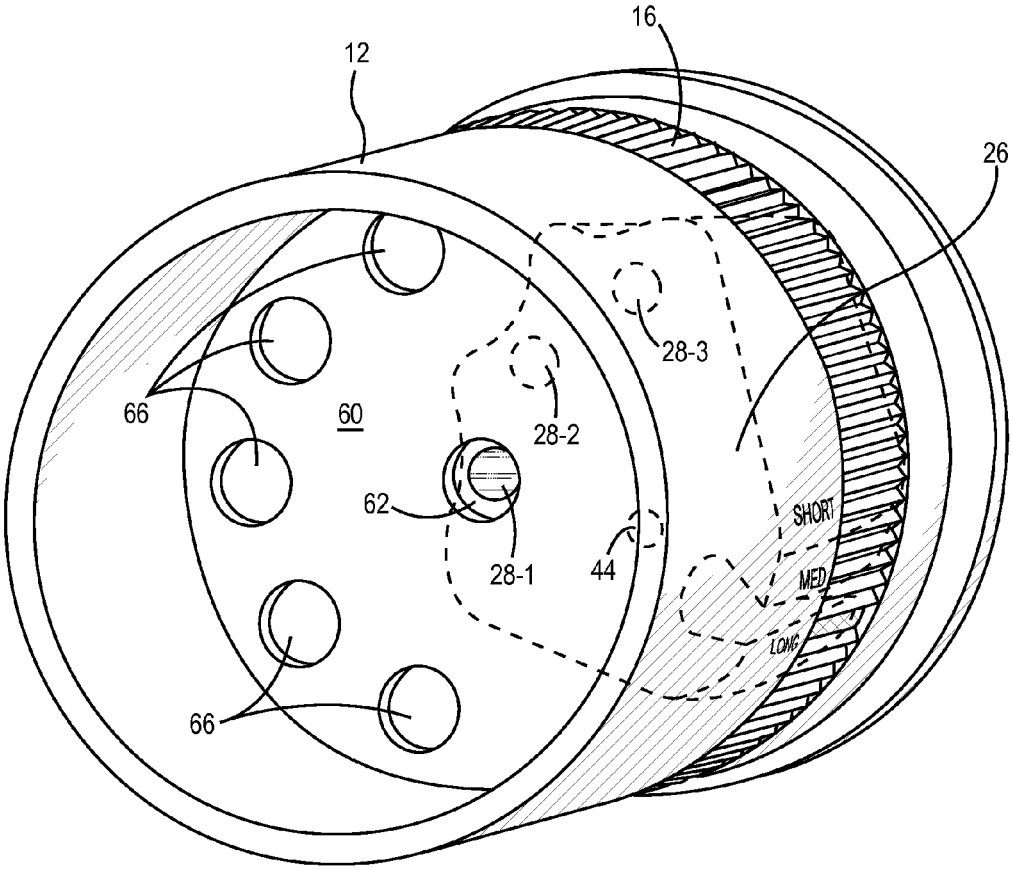
FIG. 4 is another diagram of an annular casing illustrating a plate, according to one embodiment.

FIG. 4 is another diagram of the annular casing 12 illustrating the plate 60, according to one embodiment. FIG. 4 illustrates in dashed outline the cam 26 disposed behind the plate 60. As the cam 26 rotates in response to a rotation of the rotatable selector ring 16, either the charge 28-1, the charge 28-2, or the charge 28-3 may be concurrently aligned with both the detonation opening 62 and the primer 64, based on the desired user-selectable position 20.

Figure 5:
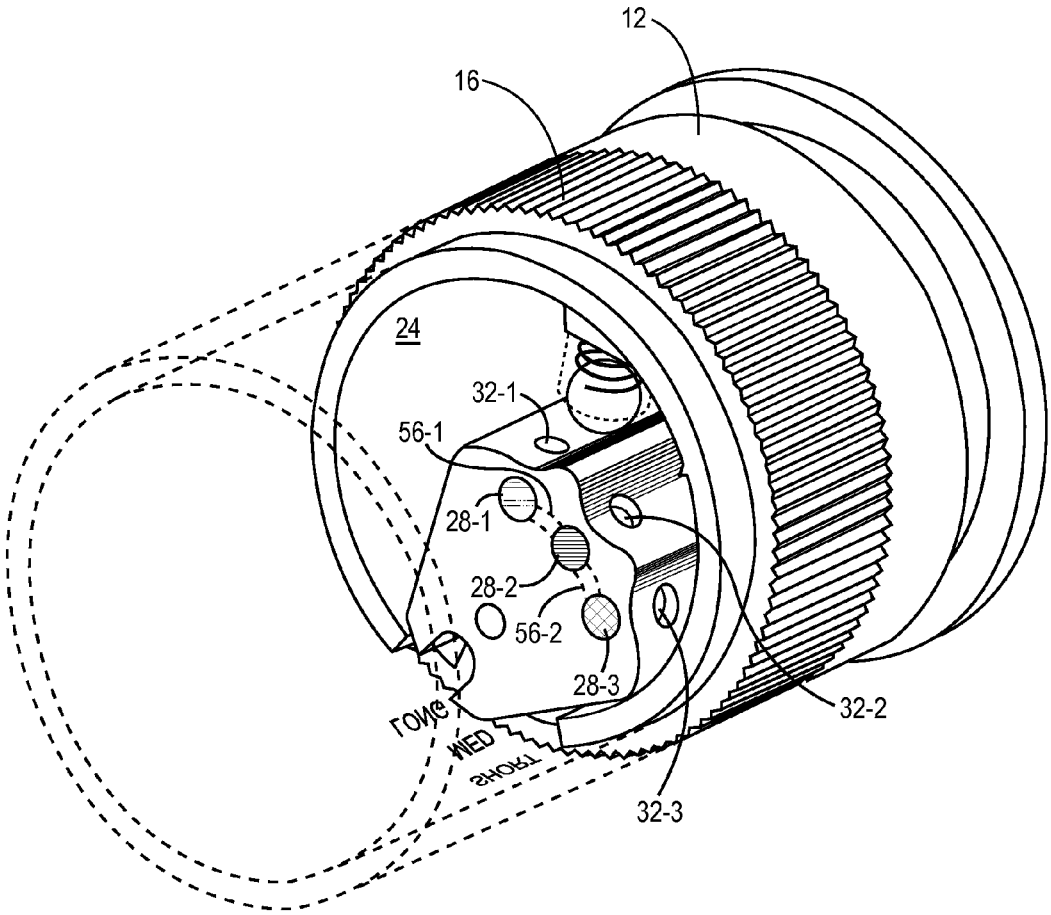
FIG. 5 is another diagram of an annular casing, according to one embodiment.

FIG. 5 is another diagram of an annular casing 12, according to one embodiment. Upon ignition of a desired charge 28, such as the charge 28-1, the charge 28-1 ignites the fuse 56-1, which subsequently causes the detonation of the charge 28-2. The energy generated by the charge 28-2 is vented through the vent openings 32-2 and into the interior void 24 and vented through the openings 66 of the plate 60 and into the pressure chamber 58 (FIGS. 3-4). The detonation of the charge 28-2 causes the ignition of the fuse 56-2 which subsequently causes the detonation of the charge 28-3. The energy generated by the charge 28-3 is vented through the vent openings 32-3 into the interior void 24 and vented through the openings 66 of the plate 60 and into the pressure chamber 58 (FIGS. 3-4). Preferably, the fuses 56-1, 56-2 comprise a material that results in detonation of the unselected charges 28 in a relatively short period of time, preferably, in less than one or two seconds, prior to a user directing the muzzle of the firearm in an unsafe direction.

The embodiments may be utilized in conjunction with any desired size of round, such as a shotgun round, a 37-millimeter caliber round, or a 40-millimeter caliber round.

Those skilled in the art will recognize improvements and modifications to the preferred embodiments of the present disclosure. All such improvements and modifications are considered within the scope of the concepts disclosed herein and the claims that follow.

What is claimed is:

1. A cartridge, comprising:

an annular casing having an interior void and a primer, the annular casing comprising an annular rim configured to inhibit forward movement of the annular casing with respect to a barrel of a firearm;

a rotatable selector ring positioned circumferentially about at least a portion of the annular casing; and a cam positioned in the interior void and comprising a first charge and a second charge, the cam coupled to the rotatable selector ring and configured to rotate about an axis in response to a rotation of the rotatable selector ring, wherein the cam is configured to align the first charge with the primer in response to a rotation of the rotatable selector ring to a first user-selectable position, and to align the second charge with the primer in response to a rotation of the rotatable selector ring to a second user-selectable position, a selected charge of the first charge and the second charge configured to, upon detonation, generate sufficient pressure to propel a projectile through the barrel of the firearm.

2. The cartridge of claim 1, wherein the annular casing forms an opening between at least a portion of the rotatable selector ring and the cam, the rotatable selector ring comprising an extension configured to extend through the opening and engage a recess of the cam to couple the cam to the rotatable selector ring.

3. The cartridge of claim 1, wherein the first charge is configured to generate a first energy upon detonation, and the second charge is configured to generate a second energy upon detonation that is greater than the first energy.

4. The cartridge of claim 1, wherein the cam further comprises a third charge, and is configured to align the third charge with the primer in response to a rotation of the rotatable selector ring to a third user-selectable position.

5. The cartridge of claim 1, wherein the cam comprises at least a first surface indentation associated with the first charge and a second surface indentation associated with the second charge, the cartridge further comprising:

a plunger disposed within the interior void, the plunger configured to engage the first surface indentation when the rotatable selector ring is in the first user-selectable position and to engage the second surface indentation when the rotatable selector ring is in the second user-selectable position.

6. The cartridge of claim 5, wherein the plunger comprises a spring in compressible communication with a ball, the spring configured to urge the ball against the cam to provide resistance via the cam to the rotation of the rotatable selector ring.

7. The cartridge of claim 1, further comprising a pressure chamber, the pressure chamber formed at least in part by a plate separating the pressure chamber from the interior void, the plate forming a first opening between the pressure chamber and the interior void, wherein in the first user-selectable position of the rotatable selector ring the cam is configured to align a detonation direction of the first charge with the first opening and, in the second user-selectable position of the rotatable selector ring, to align a detonation direction of the second charge with the first opening, such that a selected charge of one of the first charge and the second charge detonates into the pressure chamber.

8. The cartridge of claim 7, wherein the plate further forms a second opening between the pressure chamber and the interior void that facilitates pressure exchange between the interior void and the pressure chamber upon detonation of an unselected charge.

9. The cartridge of claim 7, wherein the primer is configured to, upon ignition, detonate the selected charge of the one of the first charge and the second charge that is aligned with the primer.

10. The cartridge of claim 1, wherein the first charge is located in a first void of the cam and the second charge is located in a second void of the cam, and wherein the cam forms a first vent opening between the first void and the interior void and forms a second vent opening between the second void and the interior void.

11. The cartridge of claim 10, further comprising a first burstable layer positioned between the first charge and the first vent opening and a second burstable layer positioned between the second charge and the second vent opening.

12. The cartridge of claim 11, further comprising a fuse coupled between the first charge and the second charge.

13. The cartridge of claim 12, wherein the fuse is positioned to ignite upon detonation of a selected charge of the first charge and the second charge, and configured to detonate an unselected charge of the first charge and the second charge.

14. The cartridge of claim 13, wherein the fuse is configured to detonate the unselected charge within a period of time between about ⅓ of a second and about 1 second of ignition of the fuse.

15. The cartridge of claim 13, wherein the unselected charge is configured to direct energy through a respective burstable cover and into the interior void upon detonation.

16. The cartridge of claim 1, further comprising a less-than-lethal projectile.

17. A multiple-charge cartridge, comprising:

an annular casing having an interior void and a primer charge, the annular casing comprising an annular rim configured to inhibit forward movement of the annular casing with respect to a barrel of a firearm;

a rotatable selector ring positioned circumferentially about at least a portion of the annular casing;

a cam positioned in the interior void and coupled to the rotatable selector ring, the cam comprising a first charge and a second charge and at least two surface indentations including a first surface indentation associated with the first charge and a second surface indentation associated with the second charge, the first charge and the second charge configured to, upon detonation, generate sufficient pressure to propel a projectile through the barrel of the firearm; and a plunger configured to selectively engage a selected surface indentation of the at least two surface indentations in response to a rotation of the rotatable selector ring to facilitate user selection of the first charge or the second charge.

18. The multiple-charge cartridge of claim 17, wherein the cam is further configured to align the first charge with the primer charge when the plunger selectively engages the first surface indentation and to align the second charge with the primer charge when the plunger selectively engages the second surface indentation.

19. A charge-selectable cartridge, comprising:

a casing forming an interior void and an exterior channel about a portion of an exterior surface of the casing, the casing comprising an annular rim configured to inhibit forward movement of the casing with respect to a barrel of a firearm;

a rotatable selector ring positioned circumferentially in the exterior channel; and a cam positioned in the interior void and rotatably coupled to the rotatable selector ring, wherein the cam is configured to set the charge-selectable cartridge to a first charge for a first range and a second charge for a second range that is different from the first range based on a setting of the rotatable selector ring, the first charge and the second charge configured to, upon detonation, generate sufficient pressure to propel a projectile through the barrel of the firearm.

20. The charge-selectable cartridge of claim 19, wherein the cam comprises the first charge and the second charge, and is configured to rotate in response to a rotation of the rotatable selector ring to set the charge-selectable cartridge to the first charge for the first range and to the second charge for the second range based on a setting of the rotatable selector ring.

* * * * *